US005173568A

United States Patent [19]

Parmer

[11] Patent Number: 5,173,568

[45] Date of Patent: Dec. 22, 1992

[54] INTEGRATED SUPERCONDUCTING RECONNECTING MAGNETIC GUN

[75] Inventor: Jerome F. Parmer, San Diego, Calif.

[73] Assignee: General Dynamics Corporation, Space Systems Division, San Diego, Calif.

[21] Appl. No.: 563,654

[22] Filed: Aug. 6, 1990

[51] Int. Cl.[5] ..... F41B 6/00

[52] U.S. Cl. ..... 89/8; 124/3; 505/876

[58] Field of Search ..... 89/8; 124/3; 307/91; 323/360; 336/84 M, DIG. 1; 310/12, 14; 318/135; 335/216; 505/1, 852, 872, 876, 879, 880

[56] References Cited

U.S. PATENT DOCUMENTS 5,016,600 5/1991 Hilal ..... 124/3

*Primary Examiner*—Stephen C. Bentley

*Attorney, Agent, or Firm*—John R. Duncan; Frank D. Gilliam

[57] ABSTRACT

A magnetic gun for the purpose of accelerating a metal clad projectile to high velocities which includes a long dipole magnet extending the length of the gun bore that encloses a plurality of short superconducting dipoles magnets along its length. The short dipoles are superconducting dipoles whose induced current and magnetic field oppose the current and magnetic field of the long dipole. The short dipoles while in a superconducting state prevent the long dipole field from entering the gun bore. When the short dipoles become normal conducting, the current in the short dipoles decay rapidly. When this occurs the field of each of the small dipoles collapse and magnetic flux from the long dipole enters the gun bore at the locaiton of the normal conducting small dipole. This entering flux repels the projectile down the barrel in the direction of least flux, so the projectile is moved to the next short dipole section. This process is repeated in the next section and sequentially down the gun bore so that the projectile is accelerated along the length of the bore and exits therefrom at launch speed.

2 Claims, 2 Drawing Sheets

SERIES OF SMALL SUPERCONDUCTING DIPOLES, INTERNAL TO THE MAIN DIPOLE

SERIES OF SMALL SUPERCONDUCTING DIPOLES, INTERNAL TO THE MAIN DIPOLE

MAIN EXTERNAL LONG DIPOLE

INTEGRATED SUPERCONDUCTING RECONNECTING MAGNETIC GUN

BACKGROUND OF THE INVENTION

The invention is directed to electromagnetic guns and particularly to electromagnetic guns which propel a metal clad projectile by repulsive electromagnetic force.

U.S. Pat. No. 3,126,789 by inventor R. X. Meyer teaches a rail gun which uses a combination of pressurized gas and electromagnetic force to exit a projectile from a barrel at launch speed. Electrical connection between the rails and the traveling projectile is required to synchronize the launch flux.

U.S. Pat. No. 4,796,511 by inventor Yehia M. Eyssa teaches a electromagnetic projectile launching system which employs a pair of opposing firing rails which extend the length of the barrel and are exposed to the projectile and a persistent magnet formed preferably by a superconducting dipole wound on the outside of the supporting structure. The projectile is driven through the barrel by plasma formed behind the projectile through which current between the rails flows.

U.S. Pat. No. 4,817,494 to inventor Maynard Cowan teaches an electromagnetic launcher which includes a plurality of electrical stages that are energized sequentially in synochony with the passage of a projectile. Each stage of the launcher includes two or more coils which are arranged coaxially on either closed-loop or straight lines to form gaps between their ends. The projectile has an electrically conductive gap-portion that passes through all of the gaps of all stages in a direction transverse to the axes of the coils. The coils receive an electrical current, store magnetic energy and convert a significant portion of the stored energy into kinetic energy of the projectile by magnetic reconnection as the gap portion of the projectile moves through the gap. The magnetic polarity of the opposing coils is in the same direction, e.g. N-S-N-S. A gap portion of the projectile may be formed from aluminum and is propelled by the reconnection of magnetic flux stored in the coils which cause acceleration forces to act upon the projectile and at horizontal surfaces of the projectile near its rear.

U.S. Pat. No. 4,846,911 to E. Wayne Tackett et al. teaches a preloaded composite electromagnetic barrel and process for fabricating same. This Patent like the ones mentioned above employs a pair of opposed rails which create plasma behind the projectile for attaining launch speed.

The IEEE transactions on Magnetics of March 1984, Volume MAG-20, Number 2 (ISSN 0018-9464) teaches design and testing of high pressure railguns and projectiles.

The elimination of rails and the use of a combination of a long dipole normal residual magnet and a plurality of superconducting magnetics along the length of the barrel between the long normal conducting dipole and the projectile which are sequentially quenched or driven normal for allowing the magnetic force from the long normal conducting magnet to repelling the projectile along the barrel to achieve launch speed has never before been accomplished. There continues to be a need to produce a more efficient and economically feasible launch mechanism for projectiles. The instant invention provides an advancement of this Art toward the ultimate goal of a perfect projectile launcher.

SUMMARY OF THE INVENTION

The invention is directed to a integrated superconducting reconnecting magnetic gun (ISCRM) which utilizes the repulses forces of an elongated dipole magnet to propel a metal clad projectile through the bore of the gun barrel at increasing speed for launch therefrom. A plurality of opposing dipole superconducting dipole magnets are positioned along the barrel shielding the projectile from the magnetic field produced by the large dipole magnet and are progressively quenched in a timely fashion as the projectile progresses down the barrel to allow the magnetic fields of the elongated dipole magnet to sequentially repel the projectile along the barrel in the direction of least flux density. This action continues to accelerate the projectile through the gun bore until its launch from the end of the barrel.

An object of this invention is to provide an improved magnetic gun for launching a projectile into space.

An other object of this invention is to provide a magnetic gun with a residual long dipole magnet which extends the length of the gun barrel that is initially isolated from effect on a projectile within the gun bore and is made sequentially effective upon the projectile for accelerating the projectile along the barrel to a launch speed prior to exit therefrom.

Yet another object of this invention is to provide a plurality of short dipole superconducting magnets along the gun barrel the fields of which are induced by the residual long dipole magnet and this induced field shields the projectile from influence of the residual long dipole magnet during their superconducting state and provide no shielding when in their normal conducting state.

Other objects and advantages of this invention will become apparent from the following description taken in conjunction with the accompanying drawing Figures wherein are set forth, by way of illustration and example, certain embodiments of this invention.

BRIEF DESCRIPTION OF THE DRAWING FIGURES

DETAILED DESCRIPTION OF THE PREFERRED EMBODIMENTS OF THE INVENTION

Figure 1:
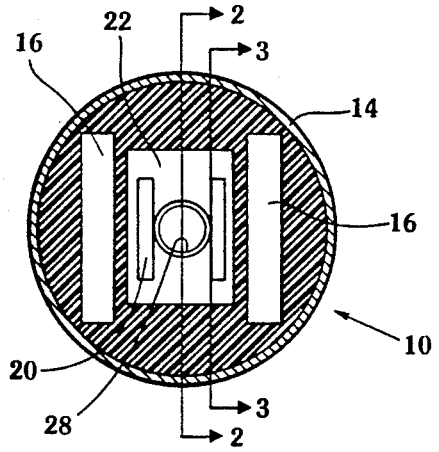
FIG. 1 depicts a schematic end view showing of the integrated superconducting magnetic gun of the invention.
Figure 2:
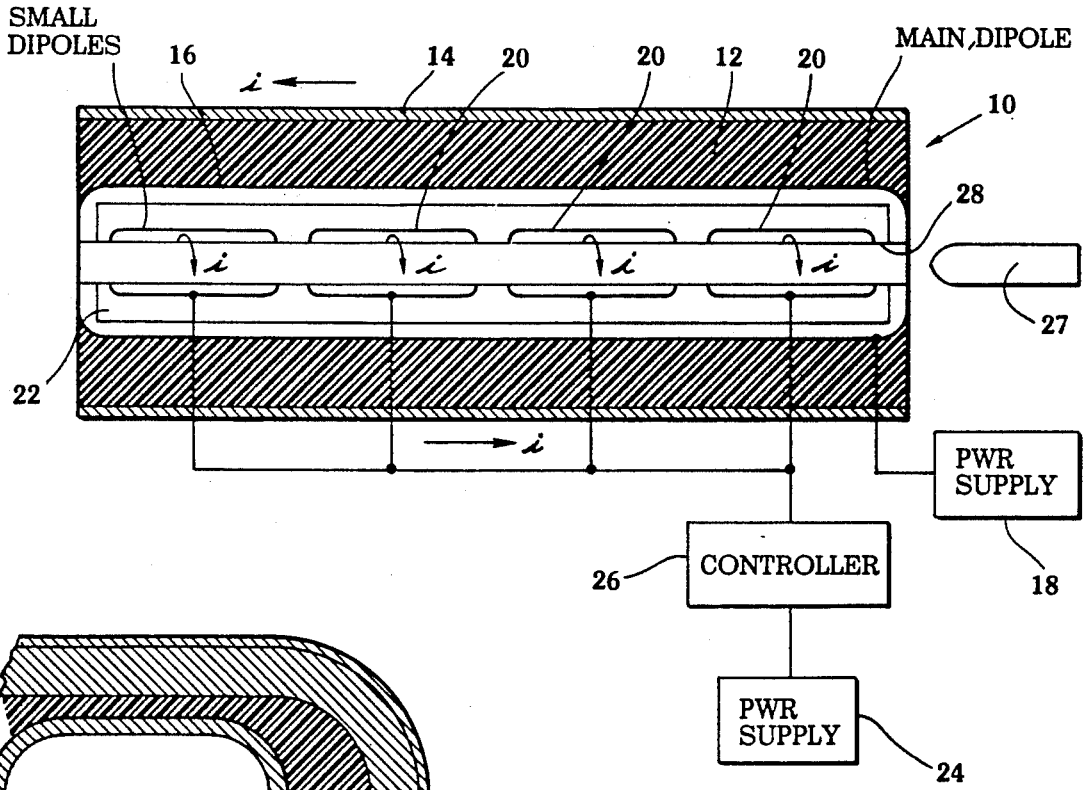
FIG. 2 depicts a schematic cutaway showing taken along line 2—2 of FIG. 1.

Referring now to drawing FIGS. 1 and 2, these FIGS. depict an end and longitudinal schematic showing of the ISCRM gun 10 of the invention. The barrel 12 is constructed of a non-magnetic material preferably a plastic material, KEVLAR or like material which does not interfere with magnetic flux. The outer surface of the barrel is covered by a metallic layer 14 which shields any magnetic flux from exiting through the outer barrel surface. Positioned within the walls of the barrel 12 is a elongated normally conducting dipole magnet 16. The magnet 16 is powered by a power supply 18. Positioned along the barrel between the long dipole magnet 16 and the central bore of the gun 10 are a plurality of superconducting short dipole magnets 20 encased in a cryogenic chamber 22 for maintaining the superconducting magnets 20 at a superconducting temperature. A description of the cryogenic chamber 22 is not provided as chambers of this nature are well known in the superconducting art and the chamber construction does not form a part of this invention. An additional power supply 24 is provide to increase the current in the superconducting short dipole magnets beyond their maximum capacity to selectively drive them normal. It should be understood that any convenient method can be employed to timely normalize the superconducting short dipole magnets. A controller 26 is connected to power supply 24. The controller 26 controls or switches the power from the power supply 24 as required to individual superconducting short dipole magnets 20 to provide a supply of excessive current to the selected superconducting short dipole magnet for selectively driving the superconducting magnets normal as the projectile 27 progresses down the bore 28. The projectile 27 has an outer surface constructed of metal such as copper, iron, etc so as to react to the magnetic flux produced by the large dipoles.

Figure 3:
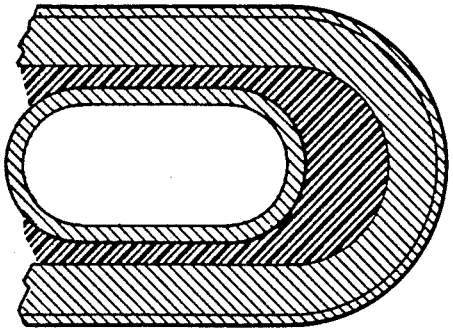
FIG. 3 depicts a partial schematic cutaway showing taken line 3—3 of FIG. 2.
Figure 4:
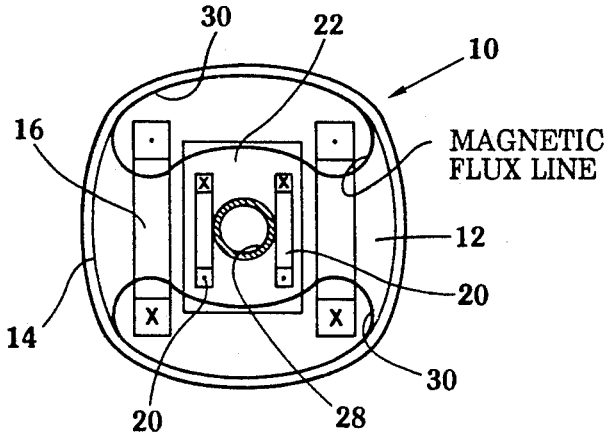
FIG. 4 depicts a schematic showing similar to FIG. 1 showing the lines of flux from the large dipole magnet shielded from the bore of the gun by the field of the small superconducting magnet in a superconducting state.
Figure 5:
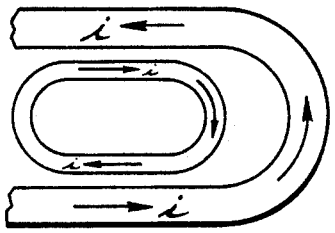
FIG. 5 depicts a schematic showing similar to FIG. 3 of the current flow in the magnets.

Referring now to drawing FIGS. 4 and 5, FIG. 4 depicts a showing similar to FIG. 1 additionally showing the flux field 30 of the long dipole magnet 16 with a typical superconducting short dipole 20 in a superconducting state charged by induced current from long dipole magnet 16 and FIG. 5 is similar to FIG. 3 additionally showing the direction of current flow in the long dipole magnet 16 and the direction of induced current flow in a typical superconducting short dipole when in a superconducting state. The metallic outer layer 14 of the barrel prevents inductance from the long dipole magnet 16 from dissipating power from the system.

Figure 6:
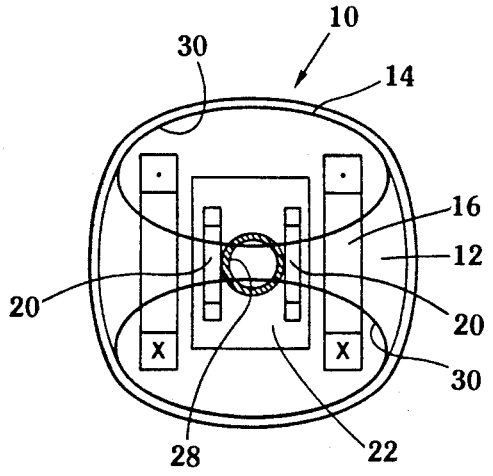
FIG. 6 depicts a schematic showing similar to FIGS. 1 and 4 showing the lines of flux from the large dipole magnet with the short dipole superconducting magnet in a quenched state.
Figure 7:
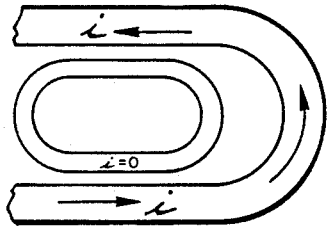
FIG. 7 depicts a schematic showing similar to FIGS. 3 and 5 showing the current flow in the magnets.

FIG. 6 and 7 are showings similar to FIGS. 4 and 5 and additionally depict the flux patterns from the long dipole magnet 16 when any one of the superconducting short dipoles 20 is driven normal by excessive current supplied from power supply 24 and the direction of current flow in the long dipole magnet 16 and the lack of any current flow in a selected superconducting short dipole 20 when the selected pair of superconducting short dipole become normally conducting.

Figure 8:
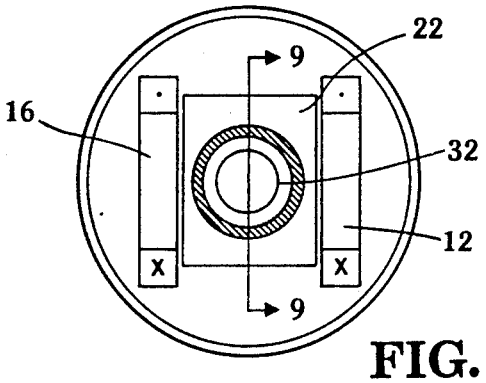
FIG. 8 depicts an end view similar to the view shown in FIG. 1 of a second embodiment of the invention.
Figure 9:
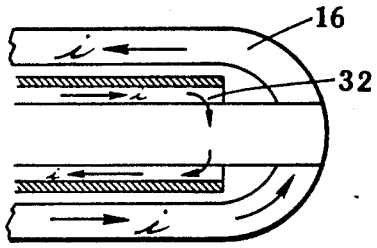
FIG. 9 depicts a partial cutaway showing taken along line 9—9 of FIG. 8.

FIGS. 8 and 9 depict a second embodiment of the invention wherein the plurality of superconducting short dipoles are replaced with an elongated tube superconducting dipole 32. FIG. 9 depicts the current flow in the long dipoles when the superconducting dipole 32 is in a superconducting state. The quenching of the superconducting dipole is similar to that previously explained above and will be further explained below in the discussion directed to the operation of the second embodiment of the present invention.

OPERATION OF THE PREFERRED EMBODIMENT

Referring now to the drawing FIGS. 1–7, to initiate the launch, the long dipole magnet is powered to maximum capacity and the short dipoles are made superconducting. The long dipole induces a similar but opposing current flow in all of the short superconducting dipoles. The flux from the long dipole is now shielded from entering the bore of the gun. When a projectile is to be fired from the gun, the projectile is launched into the barrel by any convenient means such as, a powder charge, hydraulically, pneumaticly, et, simultaneously, the first superconducting short dipole into which the projectile is introduced is driven normal causing the field of this superconducting short dipole to collapse and the flux from the long dipole repels the projectile in the direction of least flux density accelerating the projectile into the influence of the next superconducting short dipole and sequentially down the gun bore so that the projectile is continually accelerated along the length of the bore. The quenching of each superconducting short dipoles in the proper sequence is timed by the controller by preprogramming. The timing of the programmer can be established mathematically or by trial and error.

THE OPERATION OF THE SECOND EMBODIMENT

The second embodiment as depicted in drawing FIGS. 8 and 9, uses a single elongated tube superconducting dipole 32 instead of a series of superconducting short dipoles 20. In this embodiment, the current induced in the tube in a superconducting state from the long dipole magnet is excluded from the bore. If a quench is initiated at one end of the superconducting tube magnet, it will propagate down the tube to allow flux from the long dipole magnets into the bore and effect the same acceleration on a projectile as described above.

While there have been shown and described preferred embodiments of the integrated superconducting reconnecting magnetic gun in accordance with the invention, it will be appreciated that many changes and modifications may be made therein without, however, departing from the essential spirit thereof.

What is claimed is:

1. An improved magnetic gun comprising:

a barrel having an outer metal surface and an inner bore for launching a metal clad projectile;

an elongated dipole magnet positioned within said barrel between said outer metal surface and said bore;

a plurality of superconducting short dipole magnets positioned within said bore between said elongated dipole magnet and said bore; and control means for selectively normalizing of said superconducting short dipole magnets whereby when said projectile is launched into said bore said superconducting short dipole magnets are sequentially driven normal repelling said projectile and accelerating it along said bore where it exits the end of said bore at a high speed.

2. An improved magnetic gun comprising:

a barrel having an outer metal surface and an inner bore for launching a metal clad projectile;

a pair of opposing dipole magnets positioned within said barrel between said outer metal surface and said bore; and a tubular superconnecting dipole magnet positioned in said barrel between said pair of opposing elongated dipole magnets and said bore whereby when said projectile is launched into said bore and said tubular superconducting magnet is driven normal at one end thereof the normalization propagates down the tube to allow flux into the bore repelling said projectile and accelerating it along said bore where it exits the end of said bore at a high speed.

* * * * *